US008299993B2

(12) United States Patent
Hamada

(10) Patent No.: US 8,299,993 B2
(45) Date of Patent: Oct. 30, 2012

(54) IMAGE DISPLAY APPARATUS AND SETTING METHOD OF IMAGE DISPLAY APPARATUS

(75) Inventor: Yasuhiro Hamada, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 735 days.

(21) Appl. No.: 11/132,344

(22) Filed: May 19, 2005

(65) Prior Publication Data

US 2005/0264512 A1 Dec. 1, 2005

(30) Foreign Application Priority Data

May 31, 2004 (JP) ..... 2004-161747
Mar. 31, 2005 (JP) ..... 2005-102592

(51) Int. Cl.
*G09G 3/36* (2006.01)

(52) U.S. Cl. ..... 345/88; 345/98; 345/99; 345/100

(58) Field of Classification Search ..... 345/98–100, 345/30, 55, 84, 87
See application file for complete search history.

(56) References Cited

U.S. PATENT DOCUMENTS

| | | | | |
|---|---|---|---|---|
| 6,023,533 | A * | 2/2000 | Sano et al. | 382/274 |
| 6,711,289 | B1 * | 3/2004 | Sakamoto | 382/167 |
| 6,946,310 | B2 * | 9/2005 | Koyama | 438/27 |
| 7,450,089 | B2 * | 11/2008 | Son | 345/60 |
| 2003/0045043 | A1 * | 3/2003 | Koyama | 438/200 |

FOREIGN PATENT DOCUMENTS

| | | | |
|---|---|---|---|
| JP | 02-271388 | A | 11/1990 |
| JP | 08-036159 | A | 2/1996 |
| JP | 11-046316 | A | 2/1999 |
| JP | 2000-172233 | | 6/2000 |
| JP | 2003-076315 | A | 3/2003 |

* cited by examiner

*Primary Examiner* — Amare Mengistu
*Assistant Examiner* — Insa Sadio
(74) *Attorney, Agent, or Firm* — Fitzpatrick, Cella, Harper & Scinto

(57) ABSTRACT

An image display apparatus includes an image display device having a drive control unit capable of changing a scanning direction, and an image processing device for performing image processing on an inputted image signal to output the processed image signal to the image display device. In addition, a setting device adjusts an image processing setting of the image processing device correspondingly to the scanning direction of the image display device.

11 Claims, 11 Drawing Sheets

| | NORMAL | INVERSE |
|---|---|---|
| SH1 OUTPUT (R) | B | B |
| SH2 OUTPUT (G) | D | A |
| SH3 OUTPUT (B) | A | D |
| SH4 OUTPUT (R,G,B) | C | C |

IMAGE DISPLAY APPARATUS AND SETTING METHOD OF IMAGE DISPLAY APPARATUS

BACKGROUND OF THE INVENTION

1. Field of the Invention

The present invention relates to an image display apparatus and a setting method of an image display apparatus. In particular, the present invention relates to an image display apparatus capable of changing the scanning direction of an image display, and a setting method of the image display apparatus.

2. Description of Related Art

There are some digital cameras provided with liquid crystal display panels fixedly disposed on the back surfaces of their main bodies in order to make it easy to take a photograph. However, since the angles of liquid crystal panel display units are fixed to the main bodies, a user is obliged to perform photographing without visually confirming an object and the configuration thereof in an angle of view in case of performing angled photographing. Consequently, there is a case where an object which the user wants to photograph is beyond a photographing range.

Accordingly, a digital camera equipped with a liquid crystal panel display unit having a variable-angle mechanism was proposed. In such a kind of digital camera, at the time of the angled photographing, the liquid crystal panel display unit can be opened in the horizontal direction from the main body of the camera, and the opened liquid crystal panel display unit can be further rotated in the vertical direction. Consequently, it became possible for the user to confirm an object while taking a photograph by adjusting configuration while looking at the liquid crystal panel display unit.

However, in the state as it is, the display states of an image become inverse between when the liquid crystal panel display unit is reposed in the main body of the camera and when the liquid crystal panel display unit is opened from the main body of the camera and rotated. That is, it is supposed that a normal scan is being performed in the reposed state, so that the liquid crystal panel display unit is scanned from the left to the right in the horizontal direction, and is scanned from the top to the bottom in the vertical direction. In this case, in the state in which the liquid crystal panel display unit has been opened and rotated, the relation of the scanning direction in the horizontal direction and the vertical direction is opposite to that of the normal scan.

Accordingly, in the sate in which the liquid crystal panel display unit is reposed in the main body of the camera, the display direction of the image displayed on the liquid crystal panel display unit is set to be the normal scanning direction. Furthermore, in the state in which the liquid crystal panel display unit has been opened and rotated, the display direction of an image is set to be the scanning directions opposite in the horizontal and vertical directions to those of the normal scanning. Thereby, the display depending on the orientation of the liquid crystal panel display unit has been performed.

However, when the liquid crystal panel display unit has been opened and rotated, the relation between the pixel colors arranged in the horizontal and the vertical directions in the pixel array of the liquid crystal panel display unit and each of the scanning directions is also inverted. At this time, the hue of a screen changes owing to the electric characteristic of the liquid crystal structure, so that human eyes feel that the hue has changed and the brightness of the screen has changed. A technique for generating a selection voltage of a scanning signal according to the display direction of an image so as to change the brightness of a screen when the display direction of the image is switched, has been proposed as a method for improving such a change of the hue (see Japanese Patent Application Laid-Open Publication No. 2000-172233). According to this, even if the hue on a screen has changed when switching the display direction, the brightness which a user feels owing to a change of the hue can be corrected.

However, by the technique disclosed in the above-mentioned publication, both the adjustment of each image signal and the adjustment of the selection voltage of a scanning signal must be performed in response to the switching of the display direction, and consequently a problem in which a circuit becomes complicated owing to the number of adjustment elements arises. Moreover, the change of the hue is not necessarily caused by only the electric characteristic of the liquid crystal structure as disclosed in the publication document, and there is a change caused by the characteristics of a signal processing circuit at the preceding stage, such as the timing of the sample hold of the image signal. In this case, even if the selection voltage of the liquid crystal element itself is adjusted, it is difficult to perform the adjustment of a suitable hue.

SUMMARY OF THE INVENTION

The present invention is for solving the problems mentioned above, and aims to perform the adjustment of an output image changing in response to a change of the scanning direction without making a circuit complicated.

As means for achieving such an object, an image display apparatus according to the present invention comprises an image display device capable of changing a scanning direction, a processing device for processing an inputted image signal to output the processed image signal to the image display device, and a setting device for performing processing setting corresponding to the scanning direction of the image display device, to the processing device.

BRIEF DESCRIPTION OF THE DRAWINGS

The above-mentioned object of the present invention will be apparent from the following drawings and detailed descriptions based on the drawings, in which.

DETAILED DESCRIPTION OF THE PREFERRED EMBODIMENTS

Hereinafter, with reference to the drawings, an embodiment of the present invention will be described in detail.

Figure 1:
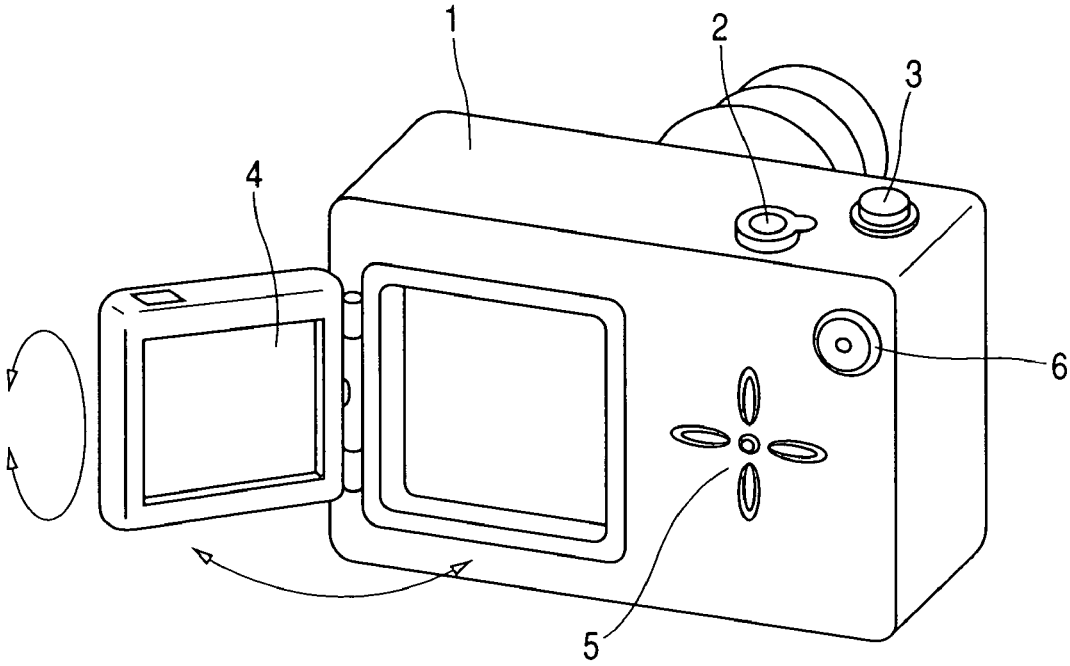
FIG. 1 is a configuration diagram showing the outline of a digital camera according to an embodiment of the present invention.

FIG. 1 is a configuration diagram showing the outline of a digital camera of the present embodiment. Reference numeral 1 denotes the main body of the digital camera. Reference numeral 2 denotes a mode switch used also as a main body electric power supply switch which turns on/off an electric power supply of the camera main body 1 and switches a photographing mode and reproducing mode. Reference numeral 3 denotes a release switch. Reference numeral 4 denotes a liquid crystal panel display unit equipped with a variable-angle mechanism for performing a photographing image display, and for displaying a shutter speed, an iris value, a number of photographed sheets, a menu and the like. Reference numeral 5 denotes a four-way operation key for operating the menu. Reference numeral 6 denotes a menu key for entering the menu.

Figure 2:
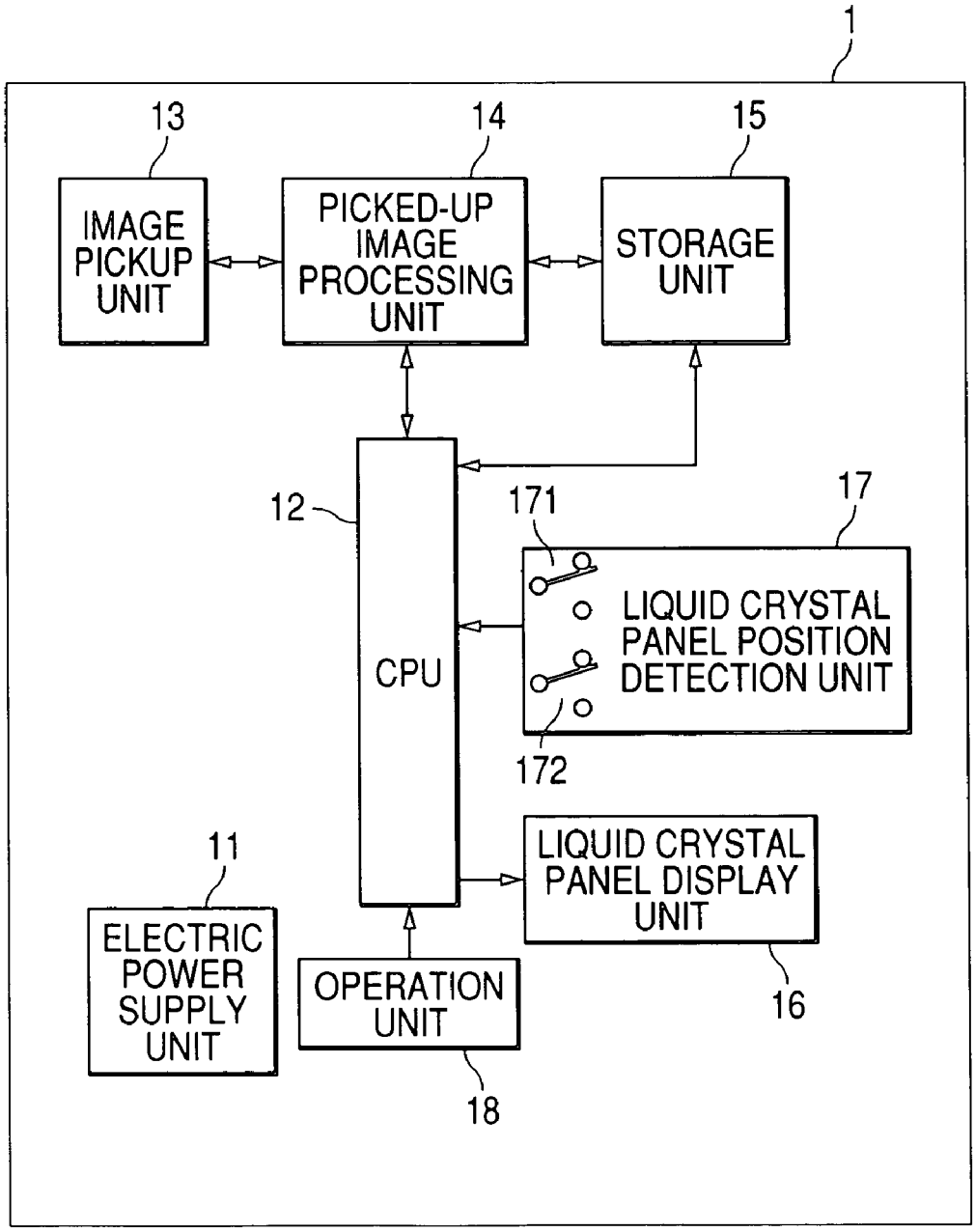
FIG. 2 is a block diagram of a control unit of the digital camera shown in FIG. 1.

FIG. 2 is a block diagram showing the outline of the configuration of a control unit of the digital camera shown in FIG. 1. Reference numeral 11 denotes an electric power supply unit for supplying an electric power supply voltage to each unit of the digital camera 1. Reference numeral 12 denotes a CPU for controlling the whole digital camera 1. Reference numeral 13 denotes an image pickup unit including a CCD image pickup device picking up an image. Reference numeral 14 denotes a picked-up image processing unit for processing a picked-up image. Reference numeral 15 denotes a storage unit for storing image data.

Reference numeral 16 denotes the liquid crystal panel display unit for displaying a photographed image and being equipped with the variable-angle mechanism to display a state of the digital camera 1 to the outside. Reference numeral 17 denotes a liquid crystal panel position detection unit for detecting the position of the liquid crystal panel display unit 16. Reference numeral 171 denotes an opening-and-closing detection switch for detecting the opening and the closing of the liquid crystal panel display unit 16. Reference numeral 172 denotes an angle detection switch for detecting an angle of the liquid crystal panel display unit 16. Reference numeral 18 denotes an operation unit for performing an operation to the camera 1.

Although not shown in FIG. 2, various circuits and the like necessary for photography and reproduction of the digital camera 1 are further connected to the CPU 12, and the CPU 12 controls the operations of each of the above-mentioned units, the circuits and the like which are not shown, in accordance with a predetermined program stored in a ROM, which is not shown.

Figure 3:
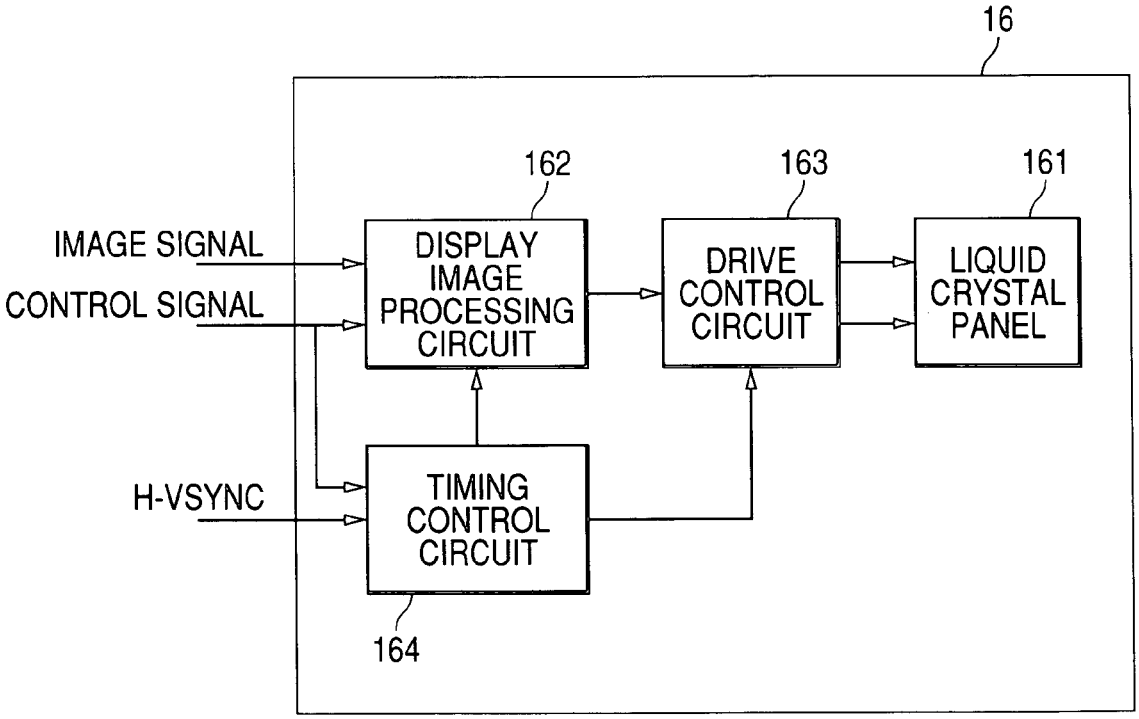
FIG. 3 is a block diagram of a liquid crystal panel display circuit.

FIG. 3 is a block diagram showing the outline of the configuration of the liquid crystal panel display unit 16. Reference numeral 161 denotes a liquid crystal panel for a display. Reference numeral 162 denotes a display image processing circuit for performing the image processing of an inputted image signal to display it on a liquid crystal panel. Reference numeral 163 denotes a drive control circuit for driving and controlling the liquid crystal panel 161. Reference numeral 164 denotes a timing control circuit for generating a timing signal of the display image processing circuit 162 and a timing signal of the liquid crystal panel drive control circuit 163.

Figure 4:
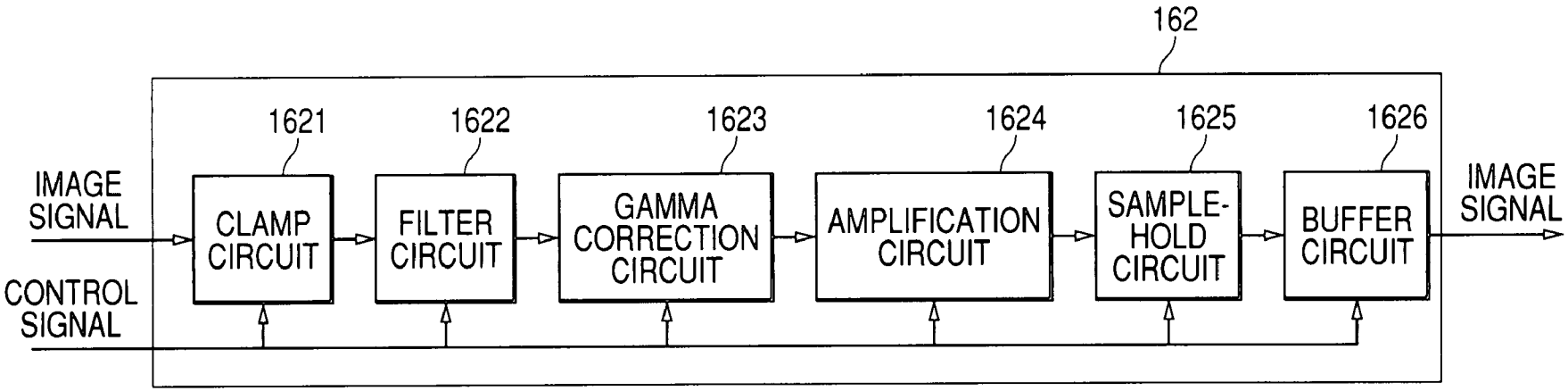
FIG. 4 is a block diagram of an image-processing circuit.

FIG. 4 is a block diagram showing the outline of the configuration of the display image processing circuit 162. Reference numeral 1621 denotes a clamp circuit for clamping an image signal (RGB signal) generated by processing an image, picked up by the image pickup unit 13, with the image processing unit 14 to a predetermined level. In addition, although the RGB signal is inputted into the display image processing circuit 162 in the present embodiment, a composite video signal, or a luminance signal and a color difference signals may be inputted. Moreover, although the analog image signal is inputted into the display image processing circuit 162 in the present embodiment, a digital image signal may be inputted.

Reference numeral 1622 denotes a filter circuit for removing unnecessary frequency band signals. Reference numeral 1623 denotes a gamma correction circuit for correcting a gradation level. Reference numeral 1624 denotes an amplification circuit for setting the image signal, to be given to the drive control circuit 163, to a predetermined value. Reference numeral 1625 denotes a sample-hold circuit for performing the sample hold of the image signal, to be given to the drive control circuit 163, at predetermined timing. Reference numeral 1626 denotes a buffer circuit for performing buffer processing to transfer the image signal to the drive control circuit 163. The CPU 12 can change the contents of the processing in each circuit by issuing a control signal to each circuit 1621-1626.

Figure 5A:
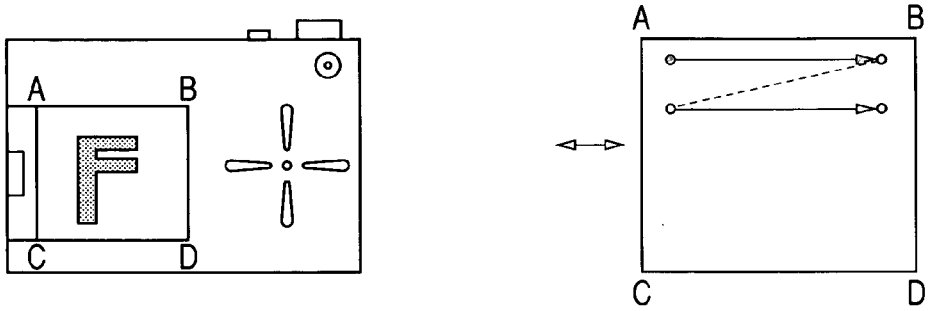
FIGS. 5A, 5B and 5C are views showing the relationship between the rotation states of a liquid crystal panel display unit 4 to the main body of the digital camera and scanning directions.
Figure 5B:
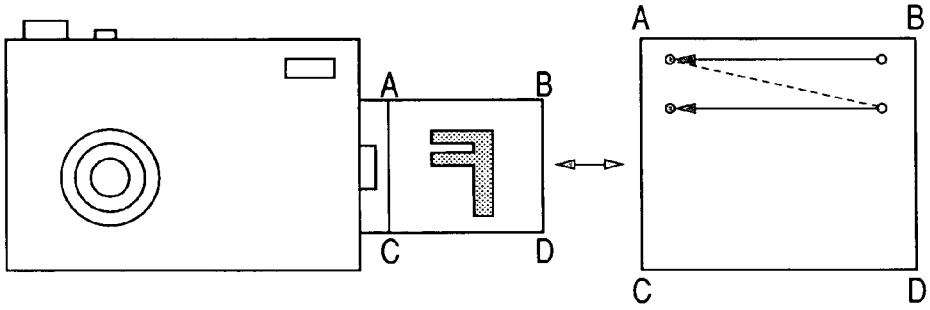
Figure 5C:
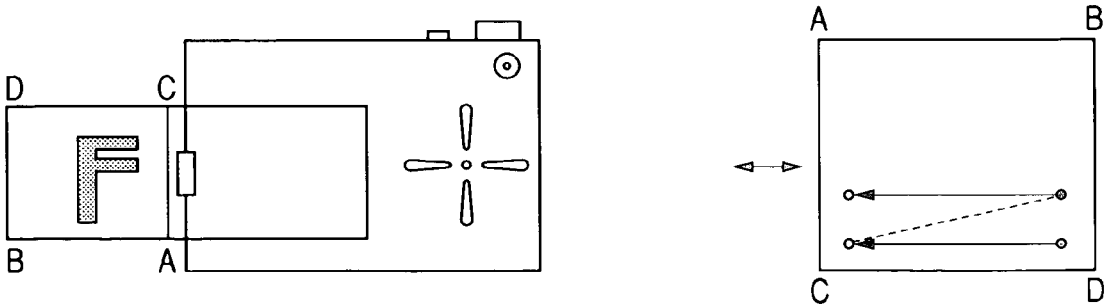
Figure 6:
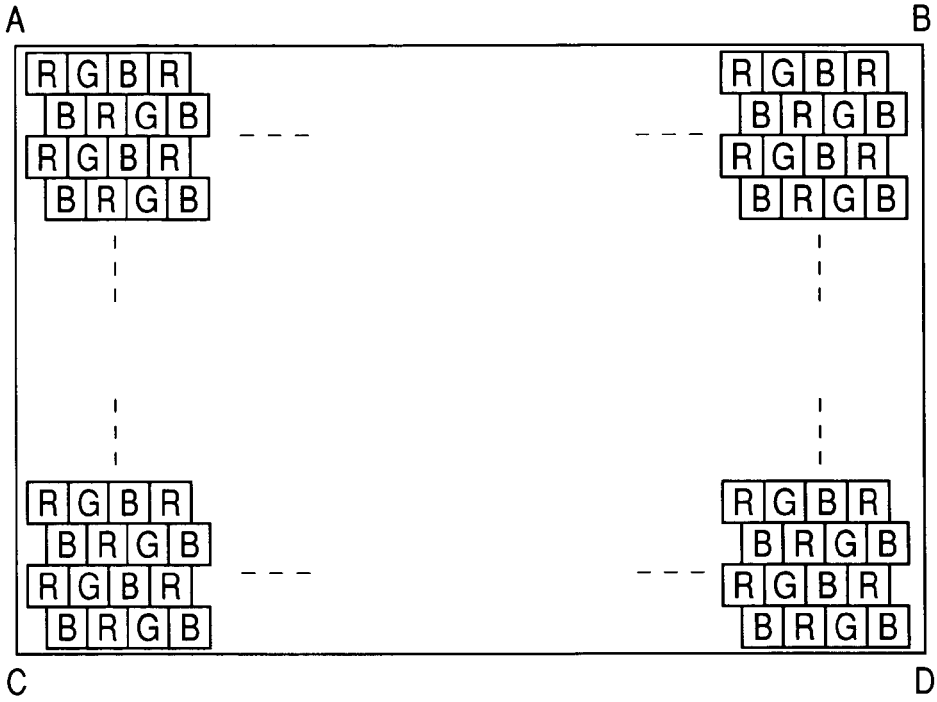
FIG. 6 is a view showing the pixel array (delta array) of a liquid crystal panel of the present embodiment in correspondence with liquid crystal panel positions.

FIGS. 5A, 5B and 5C are views showing the relationship between the rotation states of the liquid crystal panel display unit 4 with respect to the main body of the digital camera and scanning directions. Moreover, FIG. 6 is a view showing the relationship between the pixel array (delta array) of the liquid crystal panel of the present embodiment and the position thereof.

FIG. 5A shows the state in which the liquid crystal panel display unit 4 is reposed in the main body. The scanning direction in this state is supposed to be the direction of a normal scan. Moreover, in this state, as shown in FIG. 6, the liquid crystal elements are arranged in the order of B, R and G in a horizontal scanning direction, and are arranged in the order of R and B in a vertical scanning direction.

FIG. 5B shows the state in which the liquid crystal panel display unit 4 is opened from the main body. The scanning direction in this state is supposed to the direction of a horizontally inverted scan. Moreover, in this state, as shown in FIG. 6, the liquid crystal elements are arranged in the order of G, R and B in a horizontal scanning direction, and are arranged in the order of R and B in a vertical scanning direction. In addition, the display state is a state effectively usable at the time of performing, for example, facing photographing.

FIG. 5C shows the state in which the liquid crystal panel display unit 4 is opened from the main body and is rotated by 180 degrees. The scanning direction in this state is supposed to be a horizontally inverted and vertically inverted scan direction. Moreover, in this state, as shown in FIG. 6, the liquid crystal elements are arranged in the order of G, R and B in a horizontal scanning direction, and are arranged in the order of B and R in a vertical scanning direction. In addition, as already described, the display state is one effectively usable at the time of performing the variable-angle photographing.

Figure 7:
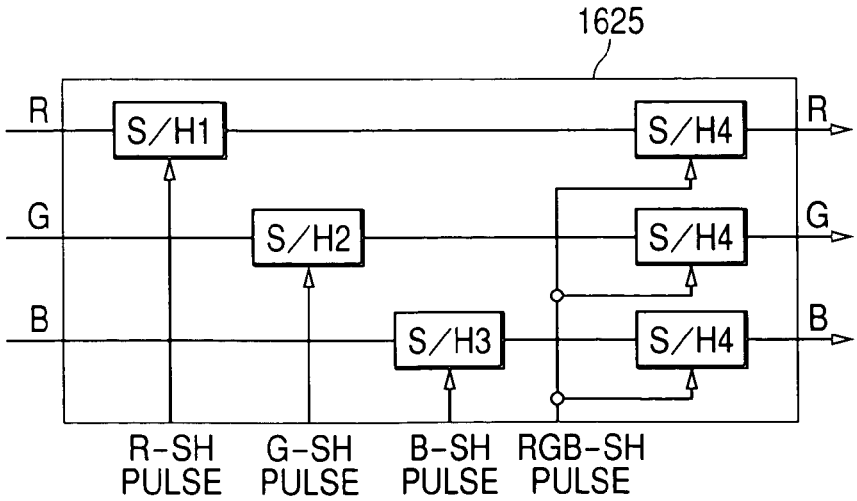
FIG. 7 is a block diagram of a sample-hold circuit.
Figures 8A, 8B:
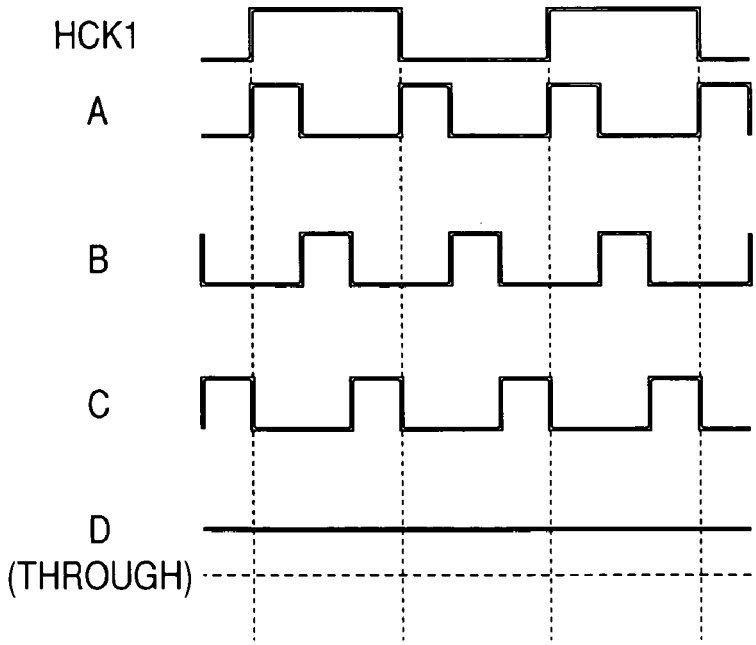
FIGS. 8A and 8B are views showing SH pulse output patterns at the time of a normal display and at the time of a horizontally inverted display.

FIG. 7 is a block diagram showing the configuration of the sample-hold circuit 1625 shown in FIG. 4. FIGS. 8A and 8B are views showing SH pulse output patterns at the time of a normal display and at the time of a horizontally inverted display. The patterns are held as a table in an internal memory of the timing control circuit 164.

The sample-hold circuit 1625 can correct each image signal (R, G and B) on a time axis in accordance with the pixel arrangement of the liquid crystal panel, which changes according to a rotation state. For the correction, the timing control circuit 164 controls the timing of a pulse input into the S/H circuit of each color.

As shown in FIG. 8B, the timing control circuit 164 outputs the timing signals SH of four patterns A, B, C and D (through) based on a horizontal synchronizing signal HCK1.

As shown in FIG. 8A, the sample-hold circuit 1625 switches sampling timing so that that each image signal at the time of the liquid crystal display based on the normal scan may be sampled in the order of B, R and G, and each image signal at the time of a horizontally inverted scan liquid crystal display may be sampled in the order of G, R and B.

Viewing a first step of the sample hold of the sample-hold circuit 1625 with respect to the scanning direction, as to the R image signal, a sample hold pulse is inputted at the same timing both at the time of a normal scan and at the time of a horizontally inverted scan.

On the other hand, as for the B image signal and the G image signal, when the scanning mode is switched from the normal scan to the horizontally inverted scan, the timings of the sample hold pulse and the through pulse are switched.

Here, although the level of each signal outputted from a circuit should be the same as one before switching, it does not become the same owing to the difference in the timing of a sample hold.

That is, the internal DC level of each signal changes even in the period of a timing change, and the output offset in level has occurred as a result. Consequently, luminance gradation and chromaticity difference are generated owing to the difference in the display direction.

Although FIGS. 8A and 8B show examples in case of the inversion in the horizontal direction, also in case of the inversion in the vertical direction, the output offset in level and the shifts in luminance gradation and chromaticity difference, similar to those in case of the inversion in the horizontal direction, are generated with regard to the colors of R and G.

In the present embodiment, in order to avoid the generation of luminance gradation and chromaticity difference, the setting processing to the LCD panel display unit 4 is performed according to an inversion state.

A liquid crystal panel display process in the digital camera having the configuration described above is described with reference to the flowchart of FIG. 9.

First, the CPU 12 performs the position detection of the liquid crystal panel at Step S101. The liquid crystal panel position detection unit 17 is outputting a detection signal in response to a position change of the switch 171 at the starting of the apparatus or during the use of the apparatus here, and the CPU 12 detects the position changes by receiving the signal.

At Step S102, the CPU 12 judges whether the liquid crystal panel display unit 16 is opened or closed, based on a detection signal received from the liquid crystal panel position detection unit 17.

At Step S102, when it is judged that the liquid crystal panel display unit 16 is closed, the process proceeds to Step S105, and the CPU 12 outputs a setting signal for a normal display to the liquid crystal panel display unit 16.

Here, the timing control circuit 164 sets timing so that the sample-hold circuit 1625 can perform sampling corresponds to the normal pixel array (B, R and G) based on the setting signal received from the CPU 12.

Moreover, the timing control circuit 164 outputs a control signal to the drive control circuit 163 so as to scan the liquid crystal panel 161 in the scanning direction (normal scanning direction) shown in FIG. 5A on the basis of a setting signal received from the CPU 12.

Furthermore, at Step S107, the display image processing circuit 162 changes a processing setting value so as to perform the image processing corresponding to the normal scanning direction based on the setting signal received from the CPU 12.

In addition, since the processing setting for the normal display is automatically set in the case of the initial starting of the apparatus, the process of Step S107 is performed in case of a transition from the other display states.

Moreover, the setting signal value to be outputted from the CPU 12 is stored in the ROM, which is not shown, as well as a setting value which will be described later. The ROM is contained in the CPU 12. The setting value stored in the ROM is read to be outputted.

After the setting process at Step S107 has finished, the process proceeds to Step S110, and the CPU 12 outputs an image signal to the liquid crystal panel display unit 16 to make the liquid crystal panel display unit 16 start a normal display.

The display image processing circuit 162 adjusts and outputs the value of the color signal of at least one color of the inputted image signal based on the processing setting value after the change at Step S107.

At Step S102, when it is judged that the liquid crystal panel 161 is opened, the process proceeds to Step S103, and the CPU 12 further judges whether the liquid crystal panel 161 has rotated or not.

When it is judged that the liquid crystal panel has not rotated, the process proceeds to Step S106, and the CPU 12 outputs a setting signal for an horizontally inverted display to the liquid crystal panel display unit 16.

Here, the timing control circuit 164 performs the timing setting so that the sample-hold circuit 1625 can perform the sampling corresponding to the pixel arrangement (B, R and G) inverted in the horizontal direction based on the setting signal received from the CPU 12.

Moreover, the timing control circuit 164 outputs a control signal to the drive control circuit 163 so as to scan the liquid crystal panel 161 in the scanning direction shown in FIG. 5B (horizontally inverted scanning direction) based on the setting signal received from the CPU 12.

Furthermore, at Step S108, the display image processing circuit 162 changes the processing setting value so as to perform the image processing corresponding to the horizontally inverted scanning direction based on the setting signal received from CPU 12.

After the setting process at Step S108 has finished, the process proceeds to Step S110, and the CPU 12 outputs an image signal to the liquid crystal panel display unit 16 to make the liquid crystal panel display unit 16 start a horizontally inverted display.

The display image processing circuit 162 adjusts and outputs the value of the color signal of at least one color of the inputted image signal based on the processing setting value after the change at Step S108.

On the other hand, when it is judged at Step S103 that the liquid crystal panel 161 has rotated, the process proceeds to Step S104, and the CPU 12 outputs a setting signal for a horizontally and vertically inverted display to the liquid crystal panel display unit 16.

Based on the setting signal received from the CPU 12, the timing control circuit 164 performs the timing setting so that the sample-hold circuit 1625 can perform the sampling corresponding to the pixel arrangement (B, R and G) inverted in the horizontal direction and the sampling corresponding to the pixel arrangement B and R inverted in the vertical direction.

Moreover, the timing control circuit 164 outputs a control signal to the drive control circuit 163 so as to scan the liquid crystal panel 161 in the scanning direction (the horizontally and vertically inverted scan direction) shown in FIG. 5C based on the setting signal received from the CPU 12.

Furthermore, at Step S109, based on the setting signal received from the CPU 12, the display image processing circuit 162 changes a processing setting value so as to perform the image processing corresponding to the horizontally and vertically inverted scan direction.

After the setting process at Step S109 has finished, the process proceeds to Step 110, and the CPU 12 outputs an image signal to the liquid crystal panel display unit 16 to make the liquid crystal panel display unit 16 start a vertically and horizontally inverted display.

The display image processing circuit 162 adjusts and outputs the value of the color signal of at least one color of the inputted image signal based on the processing setting value after the change at Step S109.

Figure 10:
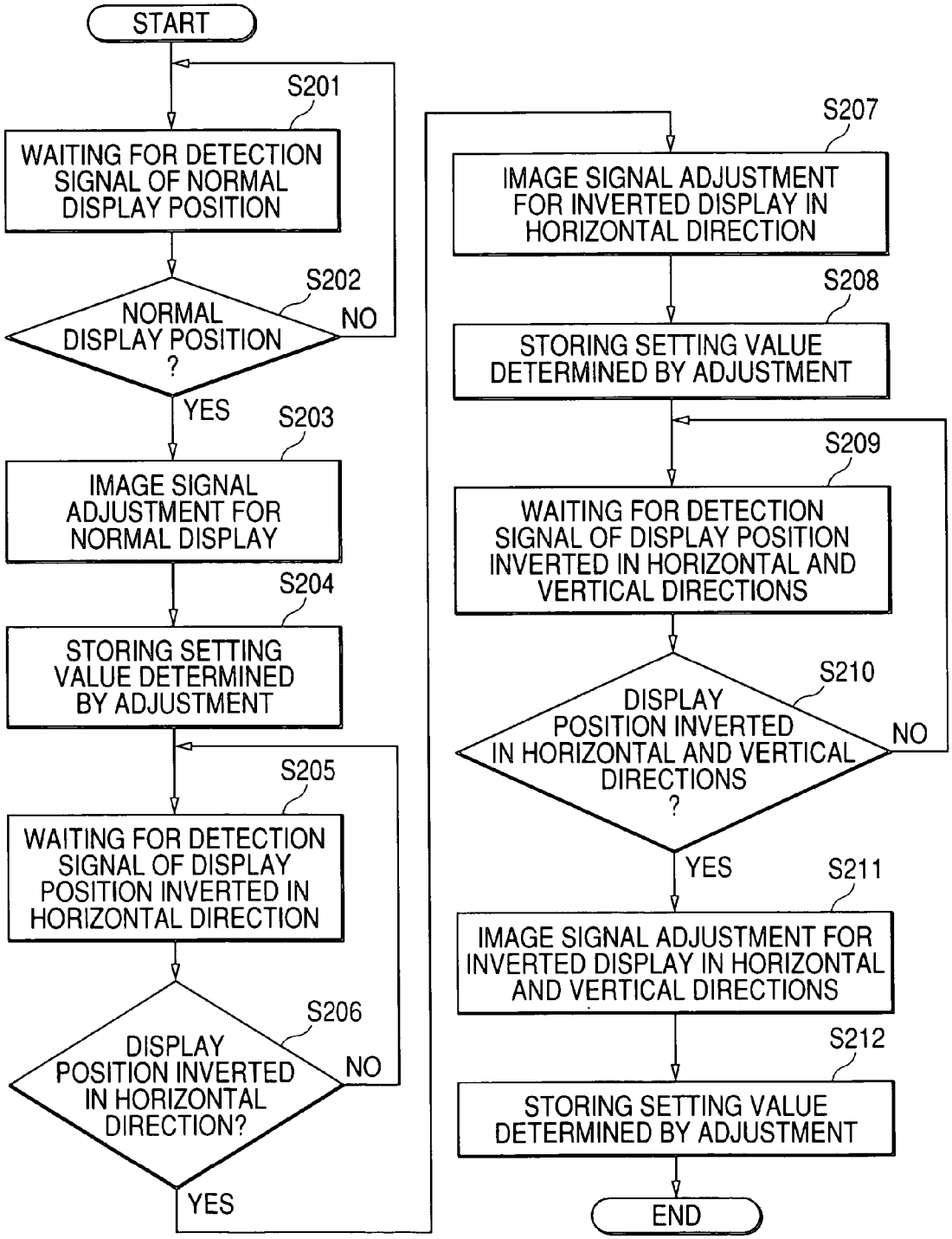
FIG. 10 is a flowchart showing a procedure of a setting value determination and storage process for the image adjustment of the liquid crystal panel.

Next, the procedure of the setting value determination and a storage process for image adjustment of the liquid crystal panel 161 is described with reference to the flowchart shown in FIG. 10.

This process can be performed in the production stage before factory shipment, for example. However, the process is not limited to be performed at that stage, but the process may be executed in response to a user's operation by providing a setting mode of an image adjustment value to the camera.

First, at Step S201, the CPU 12 waits for the outputting of a detection signal indicating that the liquid crystal panel 161 is located at a normal display position, from the liquid crystal panel position detection unit 17.

At the next Step S202, the CPU 12 judges whether the liquid crystal panel 161 is located at the normal display position or not based on the output state of the detection signal from the liquid crystal panel position detection unit 17. When the CPU 12 judges that the detection signal has not been outputted and the liquid crystal panel 161 is not located at the normal display position, the process of the CPU 12 returns to Step S201 again, and the CPU 12 waits for the output of the detection signal indicating that the liquid crystal panel 161 is located at the normal display position.

When the detection signal is outputted and the CPU 12 judges that the liquid crystal panel 161 is located at the normal display position, the process proceeds to Step S203, and the CPU 12 adjusts each image signal output (R, G and B) to be inputted to the liquid crystal panel display unit 16 to be a desired value.

Figure 11:
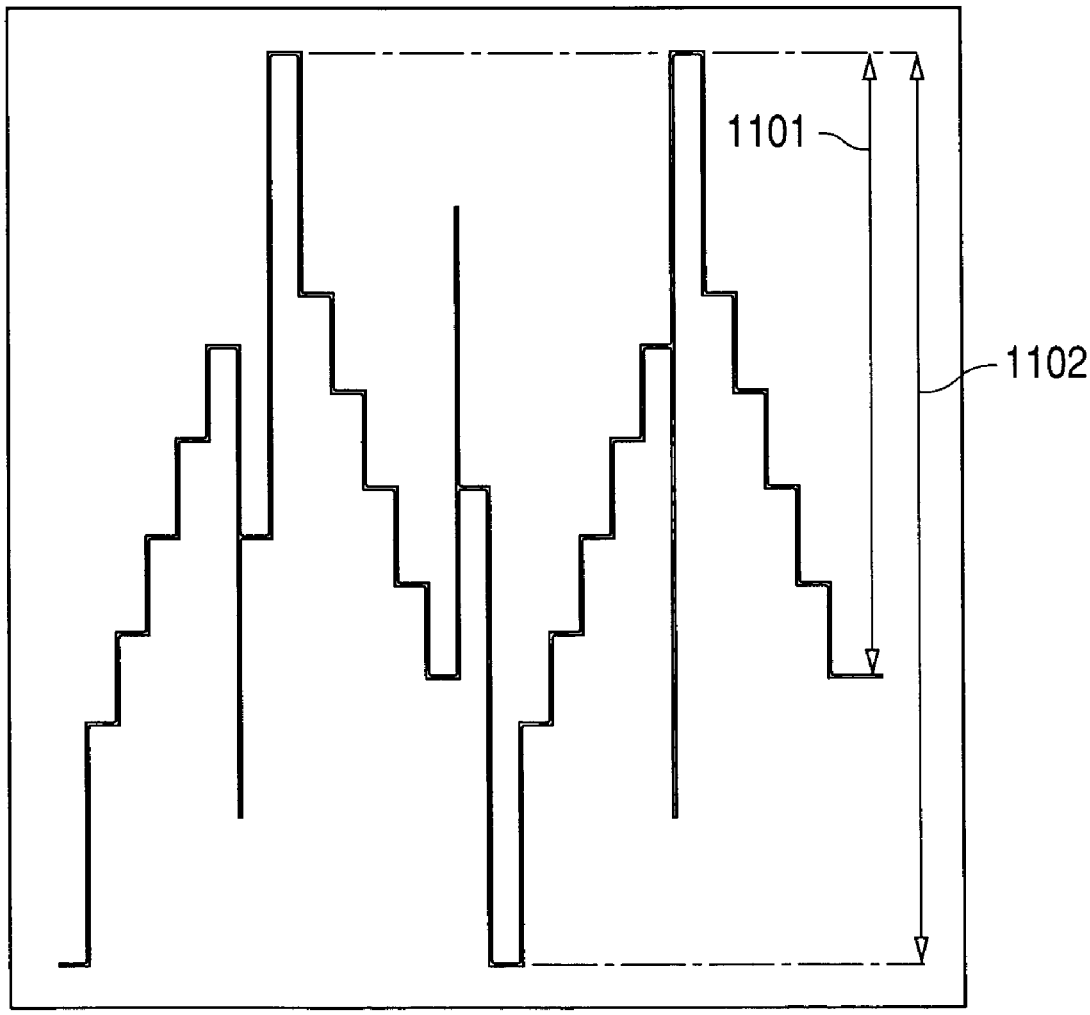
FIG. 11 is a view showing an example of an output signal from a display image processing circuit in the case of performing a normal display.

FIG. 11 is a view showing an example of a five-step signal outputted from the display image processing circuit 162 in the case of performing the normal display. This figure shows the amplitudes of a G image signal in two horizontal scanning periods. The CPU 12 adjusts the amplitudes to be a predetermined signal amplitude in the order of a bright level 1101 and the contrast level 1102.

Here, the bright level 1101 and the contrast level 1102 are adjusted by changing the setting value of the amplification circuit 1624 of FIG. 4. However, the adjustment is not limited to that way, but the display image processing circuit 162 may be configured so as to enable the adjustment by changing the setting values of other image processing circuits such as the filter circuit 1622 and the gamma correction circuit 1623.

Next, at Step S204, the CPU 12 stores the setting value determined at Step S203 into the ROM, which is not shown.

At Step S205, the CPU 12 waits for the output of the detection signal indicating that the liquid crystal panel 161 is located at the horizontally inverted display position, from the liquid crystal panel position detection unit 17.

Next, at Step S206, the CPU 12 judges whether the liquid crystal panel 161 is located at the horizontally inverted display position or not, based on the output state of the detection signal from the liquid crystal panel position detection unit 17. When the detection signal has not been outputted and the CPU 12 judges that the liquid crystal panel 161 is not located at the horizontally inverted display position, the process returns to Step S205 again, and the CPU 12 waits for the output of the detection signal indicating that the liquid crystal panel 161 is located at the horizontally inverted display position.

When the detection signal has been outputted and the CPU 12 judges that the liquid crystal panel 161 is located at the horizontally inverted display position, the process proceeds to Step S207, and the CPU 12 adjusts each image signal output (R, G and B) to be inputted to the liquid crystal panel display unit 16 to be a desired value.

Figure 12:
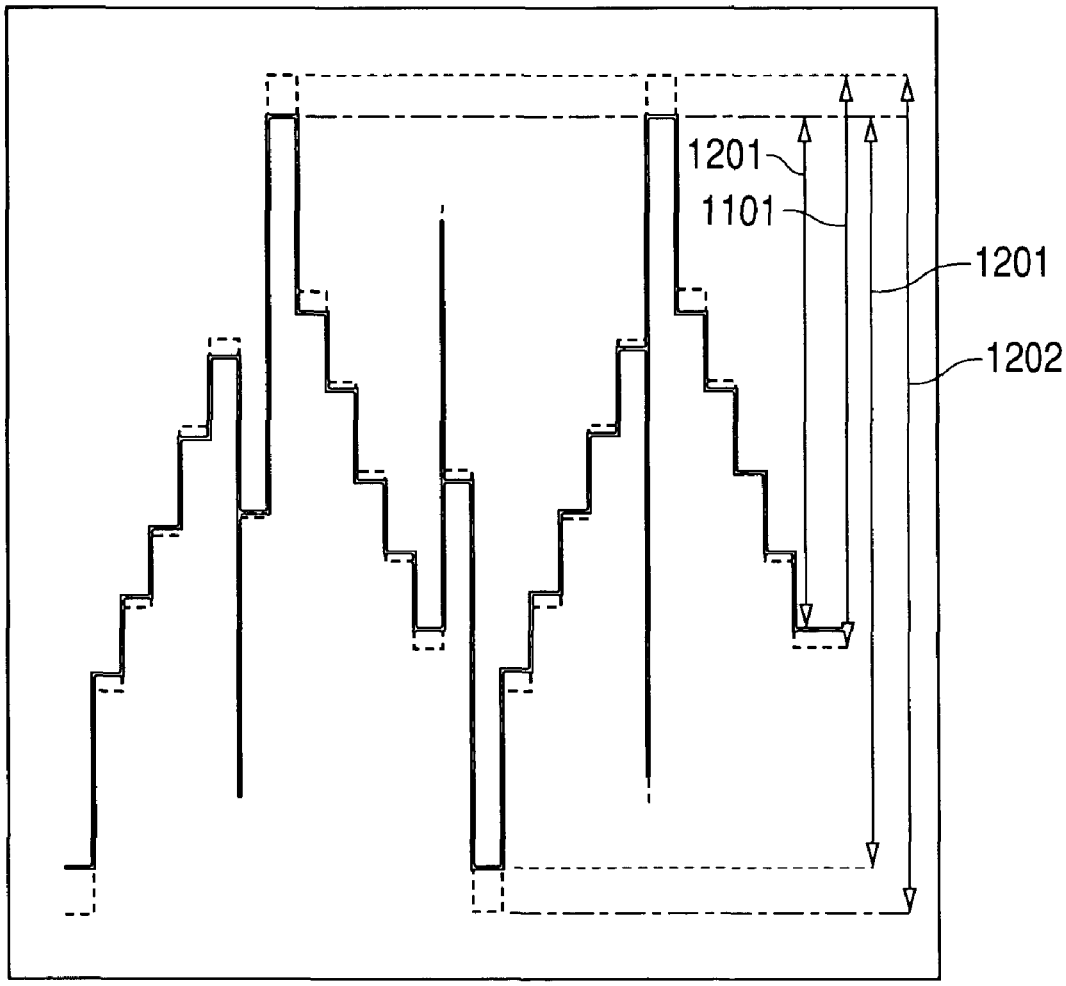
FIG. 12 is a view showing an example of an output signal from the display image processing circuit 162 in the case of performing a horizontally inverted display.

FIG. 12 is a view showing an example of the output signal outputted from the display image processing circuit 162 in the case of performing the horizontally inverted display.

In FIG. 12, a signal denoted by a solid line is a G image signal outputted from the display image processing circuit 162. Although the image signal to be inputted in the display image processing circuit 162 is the same as the one of the case of the normal display, the output signal value of the image signal greatly differs from the one of the case of the normal display.

As it has been described above, this difference is caused by the fact that the processing time of the sample-hold circuit 1625 changes according to the position change of the liquid crystal panel 161.

In the present embodiment, the adjustments of the bright level and the contrast level of each image signal (R, G and B) of the case of the horizontally inverted display are performed using the signal amplitude of the G image signal of the case of the normal display as a reference signal amplitude, to have the same signal amplitudes.

For example, in FIG. 12, the bright level 1202 and the contrast level 1201 are adjusted to be the bright level 1102 and the contrast level 1101 indicated by dotted lines of the case of the normal display.

In the present embodiment, the signal amplitude of the G image signal of the case of the normal display is used as the reference signal amplitude. But, each of the image signals (R, G and B) of the case of the horizontally inverted display may be adjusted correspondingly to each of the image signals (R, G and B) of the case of the normal display used as a reference.

Next, the CPU 12 stores the setting value determined at Step S203 into the ROM, which is not shown, at Step S208.

Next, the process proceeds to Step S209, and the CPU 12 waits for the output of the detection signal indicating that the liquid crystal panel 161 is located at the horizontally inverted display position, from the liquid crystal panel position detection unit 17.

At Step S210, the CPU 12 judges whether the liquid crystal panel 161 is located at the vertically and horizontally inverted display position or not, based on the output state of the detection signal from the liquid crystal panel position detection unit 17. When the detection signal has not been outputted and the CPU 12 judges that the liquid crystal panel 161 is not located at the horizontally inverted display position, the process returns to Step S209 again, and the CPU 12 waits for the output of the detection signal indicating that the liquid crystal panel 161 is located at the horizontally inverted display position.

When the detection signal has been outputted and the CPU 12 judges that the liquid crystal panel 161 is located at the vertically and horizontally inverted display position, the process proceeds to Step S211, and the CPU 12 adjusts each image signal output (R, G and B) to be inputted to the liquid crystal panel display unit 16, to be a desired value.

When the liquid crystal panel 161 of the delta arrangement is used, although the pixel arrangement in the vertical direction somewhat differs from that in the horizontal direction, it is clear also from FIG. 6 that hue changes similar to those in the horizontal direction are generated, and accordingly, at Step S211, the image signal adjustment similar to that at Step S207 is performed.

Then, at Step S212, the setting value determined at Step S211 is stores into the ROM, which is not shown, and the process is terminated.

Figure 9:
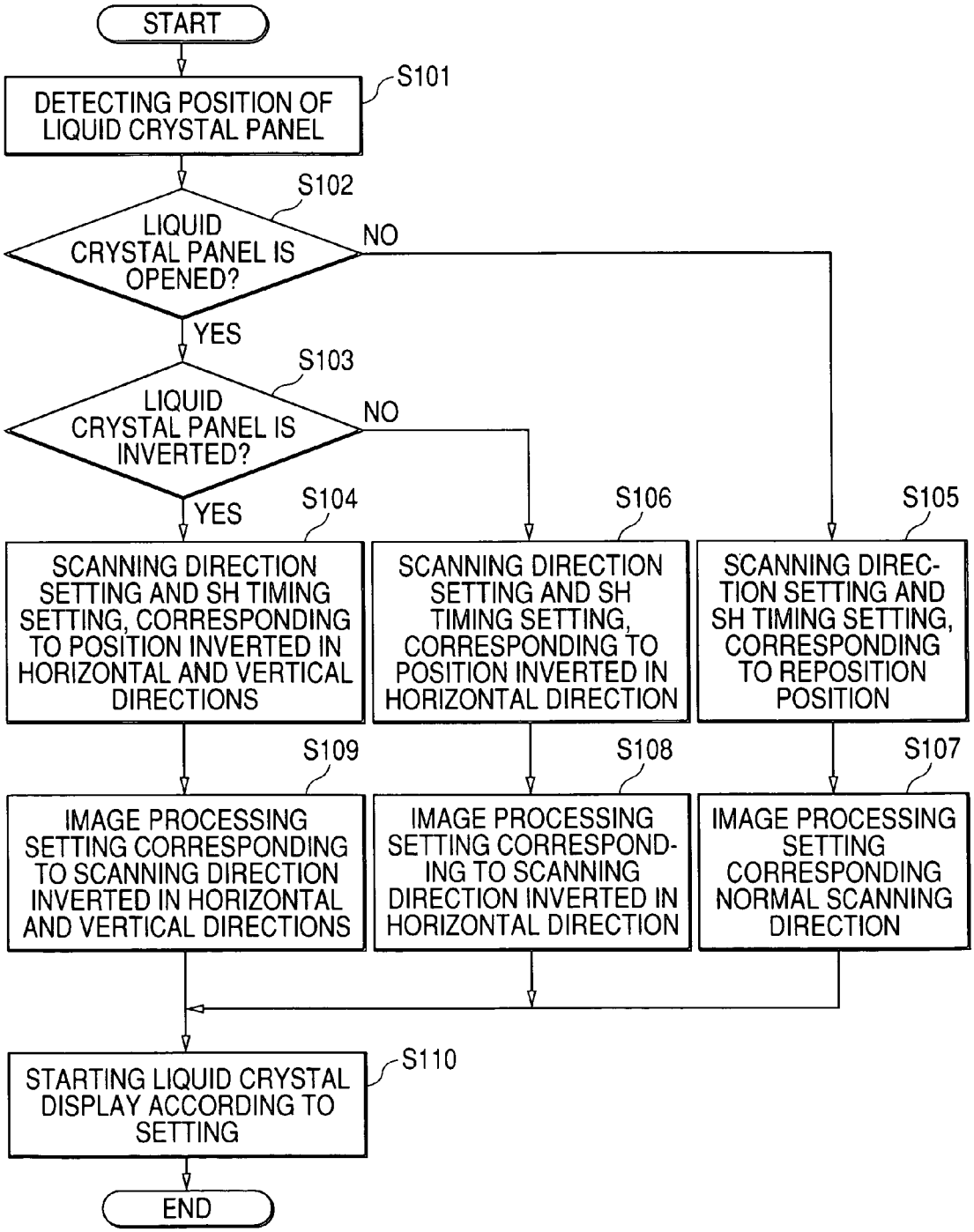
FIG. 9 is a flowchart of a liquid crystal panel display processing sequence.

The setting value which is determined by the above-described process and memorized in the ROM will be used for the adjustment of an image signal at the time of the display process of FIG. 9.

As described above, according to the present embodiment, the changes of hues caused by the characteristics of the image processing circuit such as the timing of a sample hold can be eliminated by adjusting the output values at the time of the inverse display to be the values at the time of the normal display.

OTHER EMBODIMENTS

In the above-mentioned embodiment, although the digital camera is actually operated and the processing setting is performed while adjustment is being performed by viewing the output signal values of the display image processing circuit 162, the processing setting of the present invention is not limited to such a way. For example, if the position information of a pixel arrangement, the timing information of a sample hold, the information on the amplitude value change characteristic of an input signal at the time of a sample hold, and the like are known, it is also possible to determine the processing setting value of the image processing circuit by a numerical simulation using a computer, and to store the value in advance.

In the above-mentioned embodiment, although the output value is adjusted by changing the processing setting of the display image processing circuit 162, the present invention is not limited to such a way, but the present invention can acquire the operation and advantages similar to those in such a way by changing the signal value itself of the image signal to be inputted into the liquid crystal panel display unit 16 according to a display system.

As mentioned above, although the present invention has been described based on a preferred embodiment, the present invention is not limited to the above-mentioned embodiment, but various changes and modifications can be performed in the scope shown in the claims.

This application claims priority from Japanese Patent Application Nos. 2004-161747 filed May 31, 2004 and 2005-102592 filed Mar. 31, 2005, which are hereby incorporated by reference herein.

What is claimed is:

1. An image display apparatus comprising:

an image display device including a drive control unit capable of changing a scanning direction;

an image processing device for performing image processing on an inputted image signal to output the processed image signal to said image display device, said image processing device including a sample-hold circuit which changes a sample hold timing of each of a plurality of color signals in accordance with a change in the scanning direction of said image display device and an array order of RGB color pixels equipped by said image display device; and a setting device for setting an image processing for said image processing device to change at least one of a brightness level and a contrast level of the image signal from said image processing device in accordance with the scanning direction of said image display device, before a scanning process for the image signal is performed by said image display device and said image processing device, wherein said setting device sets the image processing to change at least one of the brightness level and the contrast level to decrease a difference between a first output signal characteristic of said sample-hold circuit caused by a first sample hold timing of each of the color signals for a first scanning direction according to the array order of the RGB color pixels and a second output signal characteristic of said sample-hold circuit caused by a second sample hold timing of each of the color signals for a second scanning direction according to the array order of the RGB color pixels.

2. An image display apparatus according to claim 1, wherein said image display device is arranged to change the scanning direction to at least any one of a horizontally inverted direction and a vertically inverted direction of a normal scanning direction.

3. An image display apparatus according to claim 2, wherein said image display device includes a panel arranged so as to change its position to an apparatus main body.

4. An image display apparatus according to claim 3, further comprising a change device for changing the scanning direction into a normal direction when a position of said panel is in a reference position, to a horizontally inverted direction when the position of said panel is in a position rotated in a first direction, and to a vertically inverted direction when the position of said panel is in a position rotated in a second direction.

5. An image display apparatus according to claim 1, further comprising a setting value storage device for storing the image processing setting beforehand.

6. A setting method of an image display apparatus including an image display device having a drive control unit capable of changing a scanning direction, and an image processing device for performing image processing on an inputted image signal to output the processed image signal to the image display device, said method comprising:

an image processing step of performing the image processing by using a sample-hold circuit included in the image processing device such that the sample-hold circuit changes a sample hold timing of each of a plurality of color signals in accordance with a change in the scanning direction of the image display device and an array order of RGB color pixels equipped by said image display device;

a setting step of setting an image processing for the image processing device to change at least one of a brightness level and a contrast level of the image signal from the image processing device in accordance with the scanning direction of the image display device, before the scanning process for the image signal is performed by the image display device and the image processing device; and a display step of making the image display device display the image signal outputted from the image processing device, wherein said setting step includes setting the image processing to change at least one of the brightness level and the contrast level to decrease a difference between a first output signal characteristic of the sample-hold circuit caused by a first sample hold timing of each of the color signals for a first scanning direction according to the array order of the RGB color pixels and a second output signal characteristic of the sample-hold circuit caused by a second sample hold timing of each of the color signals for a second scanning direction according to the array order of the RGB color pixels.

7. An image display apparatus comprising:

an image display device including a drive control unit capable of changing a scanning direction;

an image processing device for performing image processing on an inputted image signal to output the processed image signal to said image display device, said image processing device including a sample-hold circuit which changes a sample hold timing of each of a plurality of color signals in accordance with a change in the scanning direction of said image display device and an array order of RGB color pixels equipped by said image display device; and a setting device for setting an image processing for said image processing device, as a setting different from a scanning order setting of pixels, to adjust at least one of a brightness level and a contrast level of the image signal from said image processing device in accordance with the scanning direction of said image display device, before a scanning process for the image signal is performed by said image display device and said image processing device, wherein said setting device sets the image processing to adjust at least one of the brightness level and the contrast level to decrease a difference between a first output signal characteristic of said sample-hold circuit caused by a first sample hold timing of each of the color signals for a first scanning direction according to the array order of RGB color pixels and a second output signal characteristic of said sample-hold circuit caused by a second sample hold timing of each of the color signals for a second scanning direction according to the array order of the RGB color pixels.

8. An image display apparatus according to claim 7, wherein said image display device is arranged to change the scanning direction to at least any one of a horizontally inverted direction and a vertically inverted direction of a normal scanning direction.

9. An image display apparatus according to claim 8, wherein said image display device includes a panel arranged so as to change its position to an apparatus main body.

10. An image display apparatus according to claim 9, further comprising a change device for changing the scanning direction into a normal direction when a position of said panel is in a reference position, to a horizontally inverted direction when the position of said panel is in a position rotated in a first direction, and to a vertically inverted direction when the position of said panel is in a position rotated in a second direction.

11. A setting method of an image display apparatus including an image display device having a drive control unit capable of changing a scanning direction, and an image processing device for performing image processing on an inputted image signal to output the processed image signal to the image display device, said method comprising:

an image processing step of performing the image processing by using a sample-hold circuit included in the image processing device such that the sample-hold circuit changes a sample hold timing of each of a plurality of color signals in accordance with a change in the scanning direction of the image display device and an array order of RGB color pixels equipped by said image display device; and a setting step of setting an image processing for the image processing device, as a setting different from a scanning order setting of pixels, to adjust at least one of a brightness level and a contrast level of the image signal from the image processing device in accordance with the scanning direction of the image display device, before a scanning process for the image signal is performed by the image display device and the image processing device, wherein said setting step includes setting the image processing to adjust at least one of the brightness level and the contrast level to decrease a difference between a first output signal characteristic of the sample-hold circuit caused by a first sample hold timing of each of the color signals for a first scanning direction according to the array order of RGB color pixels and a second output signal characteristic of the sample-hold circuit caused by a second sample hold timing of each of the color signals for a second scanning direction according to the array order of the RGB color.

* * * * *